US007976678B2

(12) United States Patent
Dougherty et al.

(10) Patent No.: US 7,976,678 B2
(45) Date of Patent: Jul. 12, 2011

(54) HIGH-YIELD PAPER AND METHODS OF MAKING SAME

(75) Inventors: Michael J Dougherty, Roy, WA (US); Amar N Neogi, Kenmore, WA (US); David W Park, Puyallup, WA (US); Brian S Delgardno, Longview, WA (US)

(73) Assignee: North Pacific Paper Corporation (NORPAC), Longview, WA (US)

( * ) Notice: Subject to any disclaimer, the term of this patent is extended or adjusted under 35 U.S.C. 154(b) by 144 days.

(21) Appl. No.: 12/346,681

(22) Filed: Dec. 30, 2008

(65) Prior Publication Data

US 2010/0163196 A1 Jul. 1, 2010

(51) Int. Cl.
*D21F 11/00* (2006.01)

(52) U.S. Cl. ..... 162/135

(58) Field of Classification Search ..... 162/135, 162/137, 175, 158, 181.1
See application file for complete search history.

(56) References Cited

U.S. PATENT DOCUMENTS

| | | | | |
|---|---|---|---|---|
| 5,418,057 | A | 5/1995 | Tokiyoshi | |
| 6,071,336 | A | 6/2000 | Fairchild et al. | |
| 6,413,591 | B1 | 7/2002 | Dettling | |
| 6,942,897 | B2 | 9/2005 | Joyce | |
| 7,501,107 | B2 | 3/2009 | Vogels et al. | |
| 2002/0170691 | A1 | 11/2002 | Nygard et al. | |
| 2003/0056915 | A1 | 3/2003 | Hietanen et al. | |
| 2003/0106658 | A1 | 6/2003 | Ilmonen et al. | |
| 2004/0065423 | A1 * | 4/2004 | Swerin et al. | 162/137 |
| 2004/0261963 | A1 | 12/2004 | Suzuki et al. | |
| 2005/0103458 | A1 | 5/2005 | Ono et al. | |
| 2005/0133179 | A1 | 6/2005 | Dougherty | |
| 2005/0133184 | A1 | 6/2005 | Dougherty | |
| 2005/0241790 | A1 | 11/2005 | Dougherty | |
| 2005/0247421 | A1 | 11/2005 | Dougherty | |
| 2005/0257907 | A1 | 11/2005 | Dougherty | |
| 2006/0054291 | A1 | 3/2006 | Dimmick et al. | |
| 2006/0102304 | A1 | 5/2006 | Nutbeem et al. | |
| 2006/0292305 | A1 | 12/2006 | Skuse et al. | |

FOREIGN PATENT DOCUMENTS

| | | |
|---|---|---|
| WO | 03/078734 | 3/2003 |

* cited by examiner

*Primary Examiner* — Mark Halpern

(74) *Attorney, Agent, or Firm* — Christensen O'Connor Johnson Kindness PLLC

(57) ABSTRACT

A high-yield paper sheet generally includes at least about 50 weight percent mechanical pulp, wherein the basis weight of the sheet is in the range of about 24 to about 60 pounds, and wherein the porosity of the sheet is in the range of about 40 to about 100 Sheffield porosity.

17 Claims, 4 Drawing Sheets

HIGH-YIELD PAPER AND METHODS OF MAKING SAME

Related patent applications include U.S. patent application Ser. No. 12/346,670, filed Dec. 30, 2008, and U.S. patent application Ser. No. 12/346,690, filed Dec. 30, 2008.

BACKGROUND

High-speed ink jet printing is a newly developed form of printing that currently is the highest speed of printing available for variable information printing. Due to the speed, the cost per page is relatively low compared to other forms of variable information printing. High-speed ink jet markets generally include high volume variable data applications, such as bills, statements, promotional and direct mail, as well as other transactional communications. A low basis weight paper, similar to a newsprint basis weight is desirable for these high-speed ink jet applications to reduce costs associated with the paper and the postage, as well as to reduce paper waste.

Past low basis weight paper grades have not been suitable for high-speed ink jet printing applications. For example, newsprint grade paper has a desirable basis weight; however, it is not fit for high-speed ink jet applications as a result of the ink and newsprint paper interactions, such as bleeding, cockling. etc. In addition, the image quality for newsprint, which is directly proportional to the specialty treatment of the paper, is poor.

Therefore, there exists a need for a high-yield paper, particularly designed to have desirable basis weight and porosity values, as well as other desirable qualities particular for high-speed ink jet printing applications.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a high-yield paper sheet generally includes at least about 50 weight percent mechanical pulp, wherein the basis weight of the sheet is in the range of about 24 to about 60 pounds, and wherein the porosity of the sheet is in the range of about 40 to about 100 Sheffield porosity.

In accordance with another embodiment of the present disclosure, a high-yield paper sheet generally includes at least about 50 weight percent mechanical pulp, wherein the basis weight of the sheet is in the range of about 35 to about 55 pounds, and wherein the porosity of the sheet is in the range of about 40 to about 100 Sheffield porosity.

In accordance with another embodiment of the present disclosure, a high-yield paper sheet generally includes at least about 50 weight percent mechanical pulp, wherein the basis weight of the sheet is in less than about 45 pounds, wherein the porosity of the sheet is in the range of about 40 to about 100 Sheffield porosity, and wherein the total color hexagon of the sheet is greater than about 0.70.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Embodiments of the present disclosure are generally directed to high-yield paper and methods of making the same. In accordance with embodiments of the present disclosure, the high-yield paper is suitable for high-speed ink jet printing applications using suitable inks, including, but not limited to water based inks, solvent based inks, and soy based inks, and resulting in good ink and paper interactions.

Yield is the percentage of the wood raw material that is in the final product. A high-yield paper is one that has a high percentage of the original wood raw material in the final paper product. Mechanical pulping is considered to be a high-yield pulping process in comparison to a chemical pulping process. A mechanical pulping process can have as high as 90 to 95% of the original wood raw material in the pulp.

In order to meet the needs of high-speed ink jet printing, embodiments of the present disclosure include high-yield papers made from a high percentage of mechanical pulp, and having a low porosity and a low basis weight. For example, in accordance with one embodiment, the high-yield paper is made from at least 50% mechanical pulp, and has a basis weight in the range of about 24 to about 60 pounds and Sheffield porosity in the range of about 40 to about 100, with a decreasing number meaning less porous (or a Gurley porosity in the range of about 30 to about 70, with an increasing number meaning less porous). Other desirable properties for the high-yield paper may include, but are not limited to, stiffness, brightness, opacity, optical density, and total color hexagon, as described in greater detail below.

High-yield paper in accordance with embodiments of the present disclosure is made using specific furnish components, using suitable formulations for the application of surface layers to the paper at the size press, and under specific machine conditions, each described in greater detail below.

Paper Making Process

Figure 1:
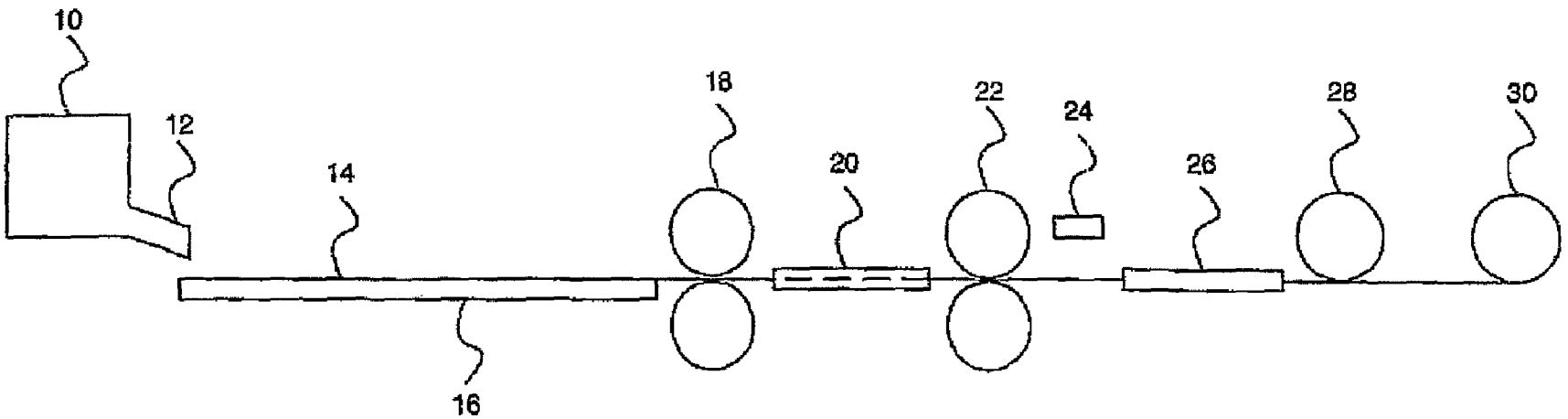
FIG. 1 is a schematic diagram of a paper machine process for uncoated paper in accordance with one embodiment of the present disclosure.
Figure 2:
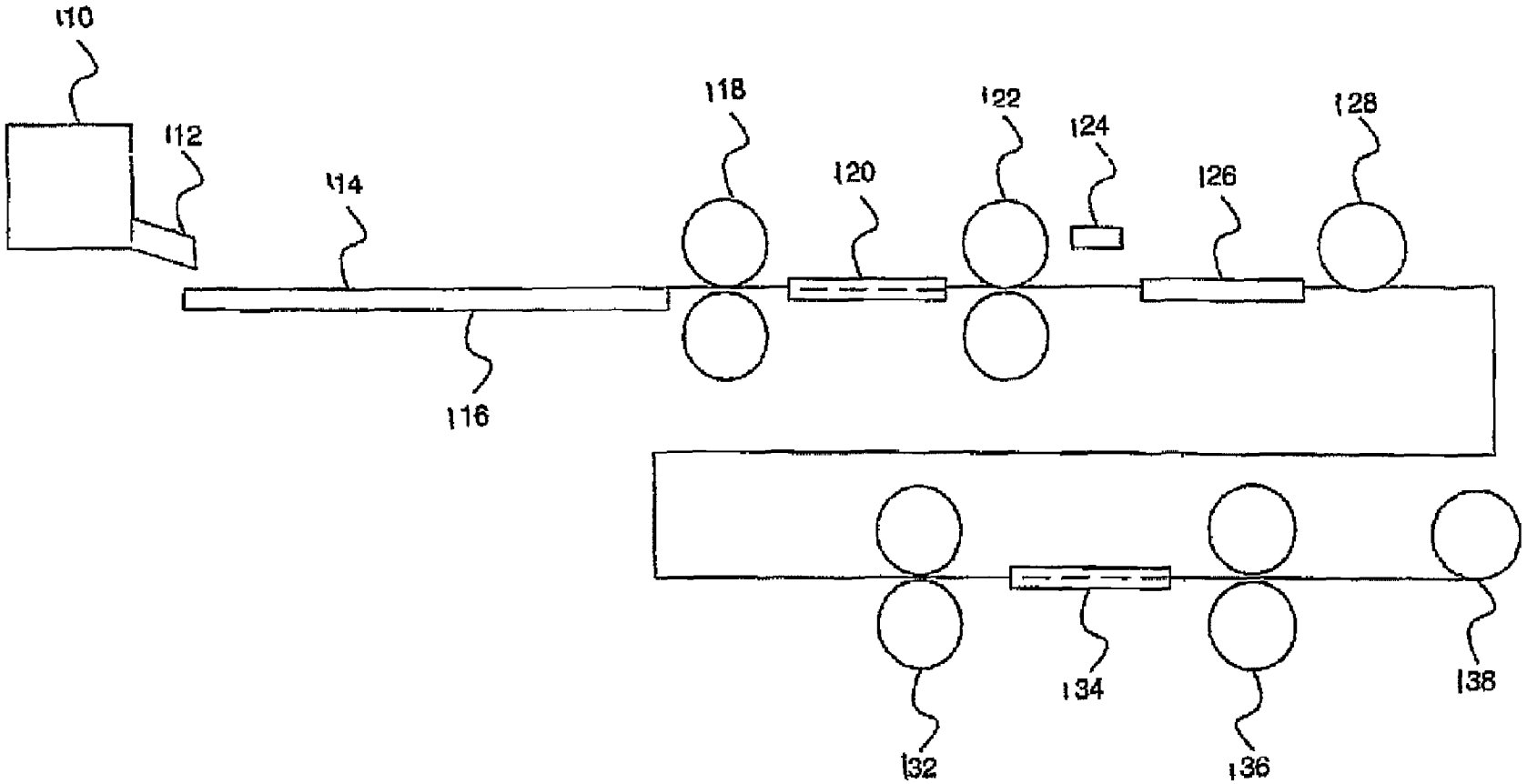
FIG. 2 is a schematic diagram of a paper machine process for coated paper in accordance with another embodiment of the present disclosure.

Prior to describing the furnish, surface layers, and machine conditions, a brief description of the paper making process is provided. Referring to FIGS. 1 and 2, methods of making the high-yield paper will now be described. FIG. 1 is a schematic drawing of a paper machine. Wood pulp fiber furnish and wet end chemicals are mixed with water in a headbox 10 to form a slurry. The slurry exits the headbox through a slice 12 onto a wire 14, wherein the water in the slurry drains from the wire. A vacuum chest 16 is also used to draw water from the slurry to form a wet paper web. The web is carried through press rolls 18 and a drier 20 that remove additional water.

Size press chemicals or materials, described herein as a surface layer, are placed on the wet paper web at the size press 22. The size press may be a horizontal type with the rolls horizontally aligned, or a vertical type with the rolls vertically aligned. The materials may be placed on the web from the rolls or from a puddle between the rolls. In some instances, materials may be placed on the web by a spraying apparatus 24. The materials described in the various embodiments in the present disclosure would also be applied at the size press 22 or the spraying apparatus 24.

The paper web then passes through a drying section 26. The drying is usually performed by steam heated drier cans through which the paper web is threaded. The paper is then calendered by calender rolls 28 and rolled into paper rolls at the winder 30. The resulting product is known as uncoated paper even though there are some materials added to the surface of the paper at the size press. The terminology in the paper industry states that this is uncoated paper because the materials on the surface of the paper were placed on the surface at the size press, prior to the dryer. The uncoated sheet may be coated in another application of one or more coating layers placed on the sheet in an off-line coating operation. After the uncoated sheet passes through an off-machine coating station and a second drying station, this resultant paper sheet is referred to as a coated paper sheet. In general, uncoated or coated printing paper has a basis weight in the range of about 16 to about 180 pounds per 3300 square feet of paper, depending on the application for the paper.

Now referring to FIG. 2, a schematic diagram for a paper machine for making coated paper will be described in greater detail. It should be appreciated that the following assembly is substantially identical in operation as the previously described embodiment shown in FIG. 1, except for differences regarding an additional off-machine coating operation to provide coated paper. For clarity in the ensuing descriptions, numeral references of like elements in the paper machine are similar, but are in the 100 series for the illustrated embodiment of FIG. 2.

As seen in FIG. 2, the web goes from the dryer 126 to the off-machine coating operation and passes through a coating station 132. Coating station 132 is shown as rolls but any type of coating equipment may be used. The web may then pass through a dryer 134 and calender rolls 136. In some installations there are calender rolls before and after the coating station 132. The paper web is then wound into rolls 138.

Slurry

The components of the slurry including the wood fiber furnish and the wet end chemicals used in accordance with embodiments and methods of the present disclosure will now be described in detail. The furnish includes mechanical pulp in a sufficient amount such that the high-yield paper includes at least about 50 weight percent mechanical pulp. Mechanical pulp is recovered through mechanical production processes that can be divided into two categories: ground wood pulp production and the thermo-mechanical process (TMP), the latter in some cases with chemical support (CTMP). Mechanical pulp is typically used in newsprint grade paper, and it is desirable pulp for use in high-yield paper because of the design parameters specific high-yield paper and the desirable opacity, caliper, print yield, and cost factors that mechanical pulp provide.

As mentioned above, in one embodiment of the present disclosure, the furnish includes sufficient mechanical pulp content such that the high-yield paper includes at least about 50 weight percent mechanical pulp fiber. The balance of the pulp content may be chemical pulp. In another embodiment, the furnish includes sufficient mechanical pulp content such that the high-yield paper includes at least about 70 weight percent mechanical pulp fiber. In yet another embodiment, the furnish includes sufficient mechanical pulp content such that the high-yield paper includes at least about 85 weight percent mechanical pulp fiber.

The high-yield furnish may include an amount of kraft fiber content to improve the strength and brightness of the high-yield paper over typical newsprint grade paper. In one embodiment of the present disclosure, the furnish includes sufficient kraft fiber content such that the high-yield paper includes about 0 to about 50 weight percent kraft fiber. In a more preferable embodiment of the present disclosure, the furnish includes sufficient kraft fiber content such that the high-yield paper includes at least about 10 weight percent kraft fiber. In other embodiments, the furnish includes sufficient kraft fiber content such that the high-yield paper includes kraft fiber in the following ranges: about 10 to about 50 weight percent kraft fiber, about 10 to about 30 weight percent kraft fiber, and about 15 to about 25 weight percent kraft fiber.

Wet end chemicals in the slurry may include fillers, such as calcium carbonate and clay. In one embodiment, the slurry includes sufficient precipitated calcium carbonate (PCC) ash such that the high-yield paper includes at least about 8 weight percent internal PCC ash. In another embodiment, the slurry includes sufficient PCC content such that the high-yield paper includes about 8 to about 24 weight percent PCC ash. In another embodiment, the slurry includes sufficient PCC content such that the high-yield paper includes about 12 to about 24 weight percent PCC ash. The PCC ash can be added to the furnish at the blend chest pump section (to the machine chest). Notably, this is amount of PCC ash is about 2 to 4 times the amount of PCC ash normally used in newsprint grade paper. Other wet end chemicals may include internal sizing, opaciliers, brighteners, and dyes.

In addition to internal PCC ash and kraft fibers, the slurry for high-yield paper in accordance with embodiments of the present disclosure generally has increased TMP freeness and increased TMP brightness over typical newsprint slurry. Increased TMP freeness is achieved through a combination of increasing throughput and decreasing refiner energy. In one embodiment of the present disclosure, the TMP freeness range for the high-yield furnish is in the range of about 60 to about 150 CSF. In another embodiment, the TMP freeness range for the high-yield furnish is in the range of about 100 to about 150 CSF. In another embodiment, the TMP freeness range for the high-yield furnish is about 120 CSF to about 150 CSF. Increased TMP freeness results in increased caliper and increased stiffness over typical caliper and stiffness values for newsprint grade paper. Typical freeness values for TMP newsprint furnish are less than about 100 CSF.

Increased TMP brightness is achieved through increased peroxide dosage, changed residence times and flows, and using trim peroxide for residual control after thickening and dilution. In one embodiment, the brightness of high-yield TMP furnish is in the range of about 65 to about 80 TAPPI. Typical brightness values for TMP newsprint furnish are about 52 to about 62.

Surface Layer

As mentioned above, additional size press chemicals or materials are placed on the wet paper web at the size press 22 to form a surface layer on the paper web. In accordance with embodiments of the present disclosure, a surface layer including pigment, binder, and/or additional surface modifying chemicals may be added to the surface of the sheet at the size press. The surface layer materials that call be placed on the web at the size press must have a viscosity which allows for the transfer of the material onto the web. In addition, some of the surface layer materials may enter into the web it the pressure of the nip at the size press is high enough. Moreover, the surface layer materials can also be sprayed on the web prior to the dryer. The majority of surface layer materials that are sprayed on the web will remain on the surface of the web.

As mentioned above, a surface layer is provided to improve the desirable qualities of the high-yield paper, for example, to improve the ink and paper interactions for high-speed ink jet printing that are not present in standard newsprint grade paper. As mentioned above, the surface layer includes pigment. In accordance with embodiments of the present disclosure, the pigment includes nano precipitated calcium carbonate (nPCC) to improve color gamut, color densities, ink bleed properties, show thru, and sheet stiffness. In one embodiment, the nPCC may be present in the surface layer in an amount in the range of about 1.25% to about 15% of the weight of the base paper. In another embodiment, the nPCC may be present in the surface layer in an amount in the range of about 1 to about 6 gsm.

"Nano" precipitated calcium carbonate refers to calcium carbonate having a mean particle size across the particle of less than about 200 nm. In one embodiment, nPCC having a mean particle size across the particle of less than about 200 nanometers is applied to the surface of a paper product. In another embodiment, nPCC having a mean particle size across the particle of less than about 100 nanometers is applied to the surface of a paper product. In another embodiment, nPCC having a mean particle size across the particle of about 15 nanometers to about 50 nanometers is applied to the surface of a paper product. In another embodiment, the nPCC having a mean particle size across the particle of less than about 40 nanometers is applied to the surface of a paper product.

The nPCC is preferably substantially non-agglomerated particles. For example, the nPCC may be formed using a high gravity reactive precipitation (HGRP) reactor to avoid particle agglomeration. A suitable nPCC is available from NanoMaterials Technology Pte Ltd (NMT).

In accordance with embodiments of the present disclosure, the nPCC surface layer may include other pigment components, including but not limited to ground calcium carbonate (GCC), calcined clay, delaminated clay, plastic pigments, silicates, mica, kaolin, benitoite, alumina trihydrate, phyllosilicant, talc, and other known pigments, as well as mixtures thereof. Ground calcium carbonate (GCC) generally has a particle size of 0.75 microns (750 nanometers).

While nPCC has self-binding capabilities, the surface layer may further include a hinder to help improve the properties of the surface layer. Suitable hinders include but are not limited to starch, latex, polyvinyl alcohol, carboxymethyl cellulose, glucomannan, protein, and other known binders, as well as mixtures thereof. In one embodiment of the present disclosure, the surface layer of the high-yield paper includes about 0.1 to about 3 gsm binder. In another embodiment, the binder in the surface layer is present in an amount in the range of about 6% to about 12% of the weight of the base paper. In one non-limiting example, starch binder in the surface layer improves the surface integrity of the high-yield paper sheet for improved ink and paper interactions for high-speed ink jet printing. For comparative information, starch content on newsprint grade paper is generally about 0.15 gsm, and about 0.8 gsm on publication grade paper (i.e., book paper).

The nPCC surface layer may further include surface modifying chemicals, such as surface sizing, salts such as nitrate salt, charge modifiers, film formers, optical brighteners, latex, cross-linkers for starch-based formulations such as glyoxal, as well as other additives.

As shown in the data collected in EXAMPLES 7 and 8 and TABLES 3 and 4 below, high-yield paper having a surface layer including nPCC generally increases in desired properties for increased amounts of nPCC content in the surface layer. For example, the data in EXAMPLE 7 and corresponding TABLE 3 shows improved stiffness, porosity, and ink density characteristics with increased nPCC to starch ratios in the surface layer, and in comparison to the GCC sample. The data in EXAMPLE 8 and corresponding TABLE 4 shows improved stiffness, porosity, and color parameters with increasing nPCC content in the surface layer.

nPCC Morphology

Figure 3:
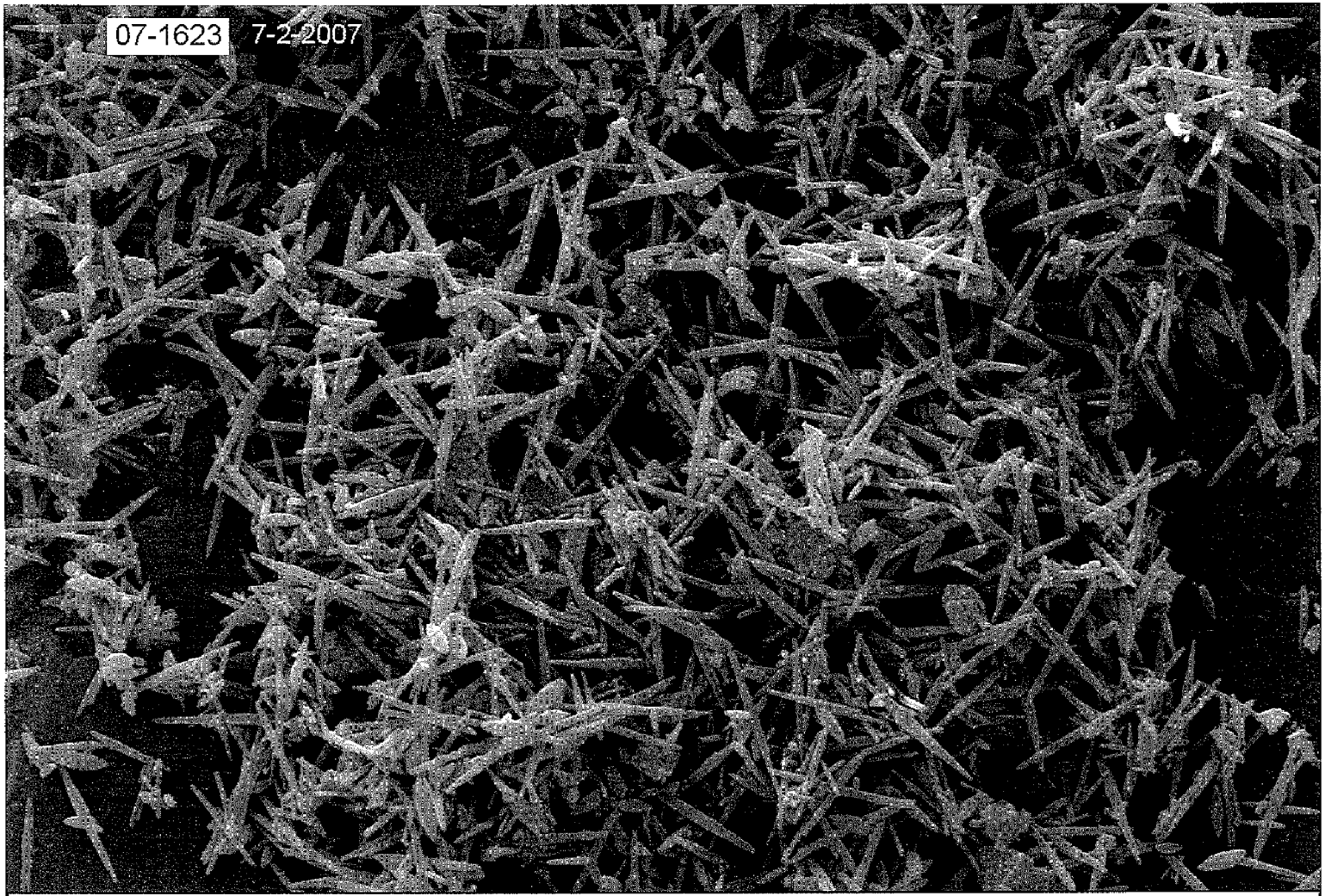
FIG. 3 is a photomicrograph of long needle nano precipitated calcium carbonate (nPCC) at 2.00 K magnification.
Figure 4:
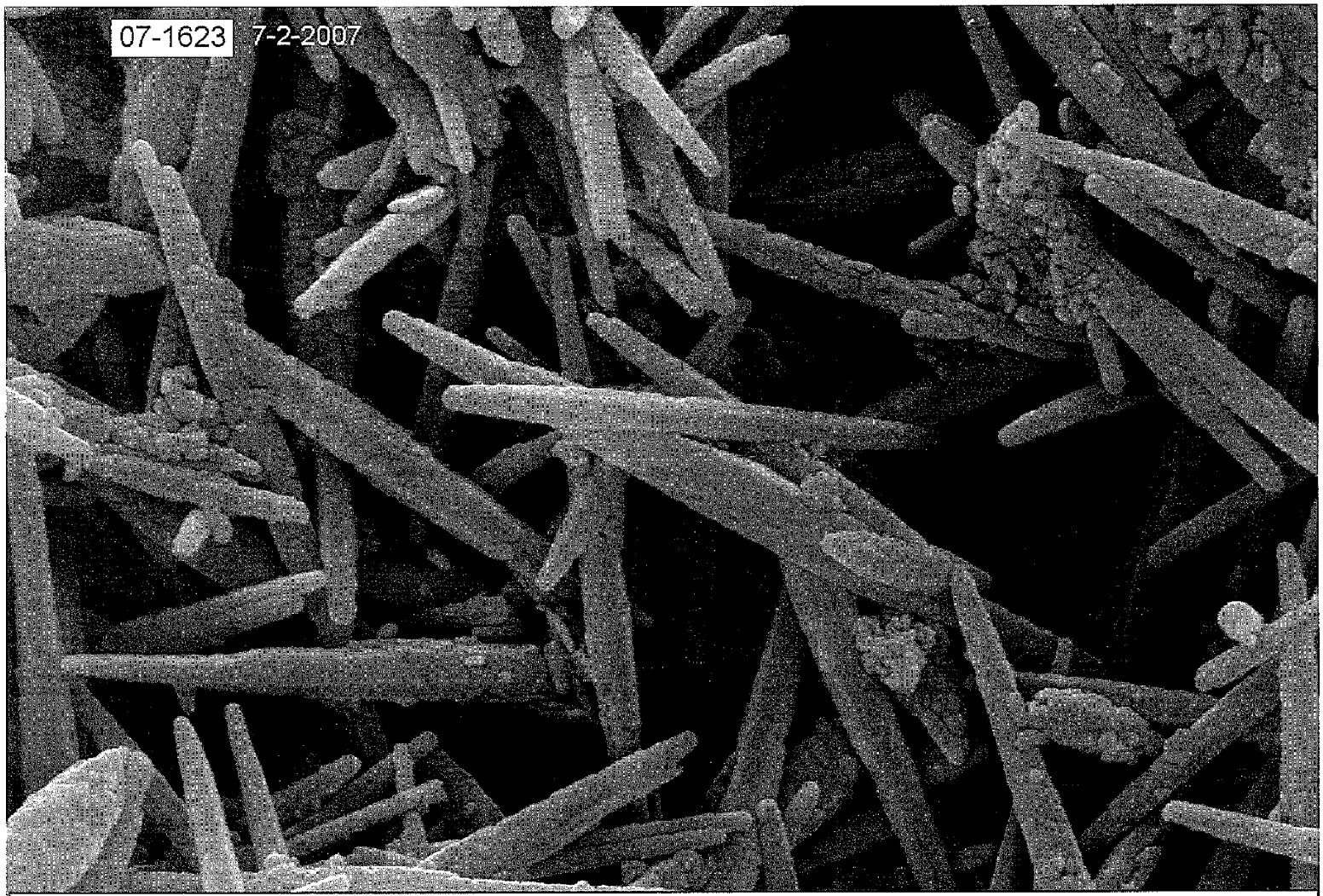
FIG. 4 is a photomicrograph of long needle nano precipitated calcium carbonate (nPCC) at 10.00 K magnification.

The morphology of the nPCC in the nPCC surface layer may also vary to further improve the properties of the high-yield paper. In that regard, nPCC is commonly available having a cubic-shaped morphology. However, nPCC having a needle-shaped morphology is also within the scope of the present disclosure. As described in greater detail below, a paper sheet that includes long needle nPCC in the surface layer has many enhanced attributes compared to a sheet that has only cubic nPCC on its surface. The long needle nPCC may be about 15 to about 200 nm in diameter, and more preferably about 15 to about 50 nm in diameter, and about 4 to about 6 microns (about 4000 to about 6000 nanometers) in length. These dimensions compare to short needle nPCC having a length of about 1 to about 3 microns (about 1000 to about 3000 nanometers). FIGS. 3 and 4 are photomicrographs of the long needle nPCC. It can be seen that a majority of the needles are long needle nPCC; however, there are some short needles and debris associated with the long needle nPCC.

Long needle nPCC may be made using the high gravity reactive precipitation (HGRP) reactor and may be obtained, for example, from NanoMaterials Technology Pte Ltd (NMT). In addition, a long needle or long cigar nPCC having a length of about 4 to about 6 microns may be available from Solvay S. A. Solvay, which makes a needle-shaped aragonite nPCC Socal 90A, NZ and P2A and a cigar-shaped calcite nPCC Solvay P1V, P2, P2V, P3E, 93V, 94V, NP, N2, N2R, or P2PHV. The discussion of long needle nPCC throughout the specification includes long cigar shaped nPCC.

As a result of the morphology, use of long needle nPCC in the surface layer increases the stiffness of paper, as compared to a paper sheet that does not have long needle nPCC applied to its surface. Improved paper stiffness allows a sheet to be used where paper stiffness is required for post printing and conversion operations. Machine direction and cross direction Gurley stiffness and machine direction and cross direction Taber stiffness were used to determine the stiffness of paper. The machine direction and cross direction Gurley stiffness of a paper sheet is determined using TAPPI test method T-543. The machine direction and cross direction Taber stiffness of a paper sheet is determined using TAPPI test method T-489. In both methods the bending resistance of paper is determined by measuring the force required to bend a sample under controlled conditions.

The long needle nPCC may be combined with other materials normally added at the size press. In one embodiment, the surface layer materials include both the long needle nPCC and starch or ethylated starch. In one embodiment of the present disclosure, the amount of long needle nPCC may be in present in the surface layer of the paper in an amount in the range of about 1.25% to about 15% of the weight of the base paper. In another embodiment of the present disclosure, the amount of starch (such as ethylated starch) may be present in the surface layer in an amount in the range of about 6% to about 12% of the weight of the base paper.

The long needle nPCC may also be combined with cubic or short needle nPCC. In one embodiment of present disclosure, long needle nPCC may be combined with an amount of cubic or short needle nPCC, such that total nPCC is in the range of from about 1.25% to about 15% of the weight of the base paper. In addition, the long needle, short needle, and/or cubic nPCC may be combined with other pigment additives.

As shown in the data collected in EXAMPLES 1-6 and TABLES 1 and 2 below, paper having a surface layer including long needle nPCC generally has a greater machine direction and cross direction Gurley stiffness and machine direction and cross direction Taber stiffness than paper having a surface layer including standard size press additives only, such as starch or ethylated starch, or with cubic or short needle nPCC alone. However, paper having a surface layer including long needle nPCC and cubic nPCC also shows greater machine direction and cross direction Gurley stiffness and machine direction and cross direction Taber stiffness than paper having a surface layer including standard size press additives only, such as ethylated starch, or with cubic or short needle nPCC alone.

In some embodiments of the present disclosure, the inventors have found that paper having a surface layer including long needle nPCC may have an increase in both machine direction and cross direction Gurley stiffness of 15 to 20% when compared with paper having a surface layer including standard size press additives, such as starch and cubic or short needle nPCC. Paper having a surface layer including long needle nPCC may have an increase in both machine direction and cross direction Gurley stiffness of 5 to 10% when compared to paper having a surface layer including cubic nPCC. Paper having a surface layer including long needle nPCC may have an increase in machine direction Gurley stiffness of 7 to 12% and an increase in cross direction Gurley stiffness of 20 to 25% when compared to paper having a surface layer including short needle nPCC.

Paper having a surface layer including long needle nPCC may have an increase in both machine direction and cross direction Taber stiffness of 13 to 20% when compared with paper having a surface layer including standard size press additives. Paper having a surface layer including long needle nPCC may have an increase in both machine direction and cross direction Taber stiffness of 5 to 12% when compared to paper having a surface layer including cubic nPCC. Paper having a surface layer including long needle nPCC may have an increase in machine direction Taber stiffness of 12 to 17% and in cross direction Gurley stiffness of 25 to 30% when compared to paper having a surface layer including short needle nPCC.

Paper having a surface layer including a combination of the long needle nPCC and cubic or short needle nPCC may also have a greater machine direction and cross direction Gurley stiffness and machine direction and cross direction Taber stiffness than paper having a surface layer including standard size press additives only, or with cubic or short needle nPCC, on in some cases long needle nPCC only.

Paper having a surface layer including a combination of long needle nPCC and cubic or short needle nPCC may have an increase in both machine direction and cross direction Gurley stiffness of 20 to 25% when compared with paper having a surface layer including standard size press additives. Paper having a surface layer including a combination of long needle nPCC and cubic or short needle nPCC may have an increase in both machine direction and cross direction Gurley stiffness of 10 to 15% when compared to paper having a surface layer including cubic nPCC. Paper having a surface layer including a combination of long needle nPCC and cubic or short needle nPCC may have an increase in machine direction Gurley stiffness of 10 to 15% and in cross direction Gurley stiffness of 25 to 30% when compared to paper having a surface layer including short needle nPCC.

Paper having a surface layer including a combination of long needle nPCC and cubic or short needle nPCC may have an increase in machine direction Taber stiffness of 15 to 20% and in cross direction Taber stiffness of 20 to 25% when compared with paper having a surface layer including standard size press additives. Paper having a surface layer including a combination of long needle nPCC and cubic or short needle nPCC may have an increase in both machine direction Taber stiffness of 7 to 12% and in cross direction Taber stiffness of 14 to 20% when compared to paper having a surface layer including cubic nPCC. Paper having a surface layer including a combination of long needle nPCC and cubic or short needle nPCC may have an increase in machine direction Taber stiffness of 15 to 20% and an increase in cross direction Gurley stiffness of 30 to 40% when compared to paper having a surface layer including short needle nPCC.

Machine Conditions

The preferred machine conditions for high-yield paper will now be described in greater detail. It should be appreciated that the properties of the high-yield paper described herein are a result in part of machine conditions that move toward paper machine conditions that are used for fine paper, rather than machine conditions that are used for typical newsprint grade paper.

In one embodiment of the present disclosure, the orientation of the sheet is squared up to improved curl properties and stiffness. Generally, typical newsprint paper is very oriented in the machine direction (MD). Therefore, squaring up the orientation of the sheet, helps lessen the orientation of the sheet in the MD direction. The sheet is squared up by running the stock jet into the former at a speed that is close to the forming wire speed, as opposed to being slower or faster than the forming wire speed.

In another embodiment, the drying conditions are altered to be more similar to those for a fine paper sheet rather than a typical newsprint sheet to improve moisture profiles and lower sheet dryness. For example, the machine may be run at about 4% to about 12% moisture into the size press and about 4% to about 10% moisture at the reel with after-dryer section steam generally greater than about 50 psig, as compared to about 10 to about 12% moisture into the size press and about 9.5% moisture at the reel with after-dryer section steam generally less than about 50 psig for newsprint grade paper.

Characteristics of High-Yield Paper

Preferred characteristics of the high-yield paper will now be described in greater detail. Such characteristics are the result of the paper furnish and chemical additives to the slurry, surface layer materials, and paper making machine conditions.

In accordance with embodiments of the present disclosure, the high-yield paper is a low basis weight paper. "Basis weight" was analyzed according to TAPPI test method T-410. The area of paper or paperboard is determined from linear measurements and mass is determined by weighing. The grammage is calculated from the ratio of the mass to the area. In one embodiment, the high-yield paper has a basis weight of less than about 55 pounds. In another embodiment, the high-yield paper has a basis weight of less than about 45 pounds. In yet another embodiment, the high-yield paper has a basis weight in the range of about 35 to about 55 pounds.

In addition to low basis weight, the high-yield paper also has a low porosity. Low porosity is achieved by the nPCC surface layer because less air is able to permeate the sheet of paper with the nPCC surface layer on the paper. Two types of instruments are generally used to measure porosity—Gurley and Sheffield. The Gurley Instrument measures "Gurley porosity" according to TAPPI test methods T-460 and T-536, which are the seconds required for given volume of air to pass through a single sheet of and is generally used for porous papers. A high reading indicates a less porous (or more dense) paper. Sheffield porosity measures the flow rate of air through a single sheet and is generally used for nonporous or dense sheets. A high Sheffield porosity reading indicates a more open paper, and a low reading indicates a less porous (or more dense) paper. Sheffield porosity is measured according to TAPPI test method T-547.

In one embodiment of the present disclosure, the high-yield paper has a Sheffield porosity in the range of about 40 to about 100, with a decreasing number meaning less porous (or a Gurley porosity in the range of about 30 to about 70, with an increasing number meaning less porous).

In accordance with other embodiments of the present disclosure, the high-yield paper has a Taber MD stiffness of greater than about 2.3. In accordance with other embodiments of the present disclosure, the high-yield paper has a Taber CD stiffness in the range of greater than about 0.7, more preferably about 0.7 to about 0.9.

In accordance with other embodiments of the present disclosure, the high-yield paper has a caliper in the range of about 3.5 to about 6.5 mils. In some cases, the paper machine may have caliper limitations that fall below this range, for example in the range of about 3.5 to about 5.0 mils.

In accordance with other embodiments of the present disclosure, the high-yield paper has a brightness in the range of about 70 to about 85 TAPPI at the reel, preferably 70 to about 90 TAPPI at the reel, and more preferably 70 to about 100 TAPPI at the reel. Brightness may be achieved through the use of kraft pulp in the furnish having a high TMP brightness, internal fillers, opacifying agents, pigmentation, and other components. Brightness is measured by TAPPI test method T-452.

Opacity is the lack of transparency that allows a sheet to conceal print on its reverse side. Opacity is greatly influenced by basis weight, brightness, type of fiber and filler. In testing, reflectance of paper is measured when backed successfully by a white body and a black body. The ratio of these two measurements determines the opacity reading. In accordance with other embodiments of the present disclosure, the high-yield paper has an opacity in the range of about 90% to about 100%. Such an opacity range may be achieved through the use of mechanical pulp in the furnish, internal fillers, opacifying agents, pigmentation, as well as other factors.

Optical properties of the high-yield paper will now be described in greater detail. "Optical density" was analyzed by a densitometer that measures darkness in terms of "optical density", defined as the negative logarithm of the reflectance of the sample. For example, a dark gray printed area that reflects 10% percent of the incident light has an optical density of $-\log(0.10)=1.00$ density units (D.U.). By taking the negative logarithm of reflectance, the resulting density measurement gives a better match with the visual impression of darkness.

A light source, usually white (a mix of all the visible colors), illuminates the sample measurement area at a 45-degree angle. Light reflected perpendicularly from the sample strikes the light detector. The detector signal is logarithmically converted and processed for display in optical density units on the readout. A black-and-white densitometer uses a white light source and a detector sensitive over the entire visible color spectrum. When the overall densitometer spectral response is comparable to human vision, the resulting measurement is called "visual" density. A color densitometer measures in red, green, and blue wavelength bands appropriate for cyan, magenta, and yellow colorants, respectively. Except for neutral gray and black samples, the reflectance and density of a given sample depend on the wavelength or color of the incident light. Red, green, and blue filters in the optical path are commonly used for separating the color bands.

Optical properties may also be measured in total color hexagon, black, cyan, magenta, and yellow color densities, as measured compared to a color control chart. Total color hexagon is a trilinear plotting system for printed ink films. Adapted for the printing industry by GATF, the method was originally developed by Eastman Kodak. A color is located by moving in three directions (at 120 degree angles) on the diagram by amounts corresponding to the densities of the printed ink film. The diagram is generally used as a color control chart, particularly for detecting changes in the hue of two-color overprints. In accordance with embodiments of the present disclosure, the high-yield paper has a total color hexagon of the sheet is greater than about 0.65, and more preferably great than about 0.70.

"Show thru" or "backside color bleed" is a measure of optical density on the opposite side of a printed paper, also measured in total color hexagon, black, cyan, magenta, and yellow color densities. This measurement helps determine the ability of a substrate to hold the ink on the printed surface and not allow the ink to "bleed" through the substrate. In accordance with embodiments of the present disclosure, the high-yield paper has a backside total color bleed value in the range of about 0.01 to about 0.07.

EXAMPLES

EXAMPLES 1-5 and associated TABLE 1 include data relating to pigment morphology and provide stiffness values for five different surface layer formulations: ethylated starch (EXAMPLE 1), cubic nPCC (EXAMPLE 2), short needle nPCC (EXAMPLE 3), long needle nPCC (EXAMPLE 4), and a mixture of the long needle and cubic nPCC (EXAMPLE 5). From the results of EXAMPLES 1-5, it can be seen that the surface layers including long needle nPCC (EXAMPLE 4) and a mixture of the long needle and cubic nPCC (EXAMPLE 5) provide greater stiffness in both machine direction and cross direction than standard materials (e.g., ethylated starch), cubic nPCC, and short needle nPCC, as discussed in greater detail below.

EXAMPLE 6 and associated TABLE 2 include data relating to pigment morphology and provide stiffness and brightness values for four different surface layer formulations: Sample A has a surface layer including control starch; Sample B has a surface layer include cubic nPCC; Sample C has a surface layer include short needle nPCC; and Sample D has a surface layer include long needle nPCC. The data shows that Gurley and Taber stiffness values in both the MD and the CD increase significantly for samples having a surface layer including 4 micron long needle nPCC. In addition, brightness values increased for samples having a surface layer including cubic, 2 micron short needle nPCC, and 4 micron long needle nPCC.

EXAMPLE 7 and associated TABLE 3 include data relating to increasing ratios of cubic nPCC compared to starch in high-yield paper samples having the following nPCC and starch surface layers: Sample A includes a surface layer having control starch; Sample B includes a surface layer having nPCC and starch in a ratio of 0.43 to 1; Sample C includes a surface layer having nPCC and starch in a ratio of 0.80 to 1; Sample D includes a surface layer having nPCC and starch in a ratio of 1.20 to 1; and Sample E includes a surface layer having GCC and starch in a ratio of 1.20 to 1. The data shows improved stiffness, porosity, and ink density characteristics over control starch and GCC with increased nPCC to starch ratios in the surface layer.

EXAMPLE 8 and associated TABLE 4 include data relating to increasing amounts of cubic nPCC while maintaining similar starch content in high-yield paper samples having the following nPCC and starch surface layers: Sample 1 includes a control starch surface layer; Sample 2 includes a GCC surface layer; Sample 3-6 include nPCC surface layers, with similar starch contents and increasing amounts of nPCC in the surface layer. Samples 1 and 2 relating to starch control and GCC surface layers were included for comparison. The data shows improved stiffness, porosity, and color parameters with increasing nPCC content in the surface layer.

Example 1

Starch Surface Layer

Seven 8½×11 sheets of 45 pound per ream newsprint were coated with ethylated starch (Penford Gum 280). The following is an average for the seven samples. The average total solids were 8% of the weight of the paper substrates. The average coated weight of the samples was 6.41 grams. The average coat weight was 2.3 grams or 58.2 pounds per ton. The ambient viscosity was 62/2. The samples were dried. The average dry weight of the samples was 4.7 grams. The samples were tested for machine direction (MD) and cross direction (CD) Gurley stiffness and machine direction and cross direction Taber stiffness. The average MD Gurley stiffness was 172.08, the average CD Gurley stiffness was 56.43, the average MD Taber stiffness was 2.18 and the average CD Taber stiffness was 0.76.

Example 2

Cubic nPCC Surface Layer

Seven 8½×11 sheets of 45 pound per ream newsprint were coated with ethylated starch (Penford Gum 280) and cubic nano precipitated calcium carbonate (nPCC-111). The following is an average for the seven samples. The average total solids were 16% of the weight of the paper substrates, 8% Penford Gum 280 and 8% cubic nPCC. The average coated weight of the samples was 6.46 grams. The average coat weight was 4.7 grams or 120.8 pounds per ton. The ambient viscosity was 355/2. The samples were dried. The average dry weight of the samples was 4.69 grams. The samples were tested for machine direction (MD) and cross direction (CD) Gurley stiffness and machine direction and cross direction Taber stiffness. The average MD Gurley stiffness was 189.04, the average CD Gurley stiffness was 61.3, the average MD Taber stiffness was 2.33 and the average CD Taber stiffness was 0.81.

Example 3

Short Needle nPCC Surface Layer

Seven 8½×11 sheets of 45 pound per ream newsprint were coated with ethylated starch (Penford Gum 280) and short needle nPCC (length 1-3 microns). The following is an average for the seven samples. The average total solids were 16% of the weight of the paper substrates, 8% Penford Gum 280 and 8% small needle nPCC. The average coated weight of the samples was 6.35 grams. The average coat weight was 4.5 grams or 117.9 pounds per ton. The ambient viscosity was 344/2. The samples were dried. The average dry weight of the samples was 4.64 grams. The samples were tested for machine direction (MD) and cross direction (CD) Gurley stiffness and machine direction and cross direction Taber stiffness. The average MD Gurley stiffness was 185.7, the average CD Gurley stiffness was 53.89, the average MD Taber stiffness was 2.17 and the average CD Taber stiffness was 0.70.

Example 4

Long Needle nPCC Surface Layer

Seven 8½×11 sheets of 45 pound per ream newsprint were coated with ethylated starch (Penford Gum 280) and long needle nPCC. The following is an average for the seven samples. The average total solids were 16% of the weight of the paper substrates, 8% Penford Gum 280 and 8% long needle nPCC. The average coated weight of the samples was 6.54 grams. The average coat weight was 4.9 grams or 127.2 pounds per ton. The ambient viscosity was 356/2. The samples were dried. The average dry weight of the samples was 4.68 grams. The samples were tested for machine direction (MD) and cross direction (CD) Gurley stiffness and machine direction and cross direction Taber stiffness. The average MD Gurley stiffness was 202.94, the average CD Gurley stiffness was 66.46, the average MD Taber stiffness was 2.48 and the average CD Taber stiffness was 0.89.

The MD Gurley stiffness of the long needle nPCC sample (EXAMPLE 4) was 18% greater than the ethylated starch sample (EXAMPLE 1), 7% greater than the cubic nPCC sample (EXAMPLE 2), and 9% greater than the short needle nPCC sample (EXAMPLE 3).

The CD Gurley stiffness of the long needle nPCC sample (EXAMPLE 4) was 18% greater than the ethylated starch sample (EXAMPLE 1), 8% greater than the cubic nPCC sample (EXAMPLE 2), and 23% greater than the short needle nPCC sample (EXAMPLE 3).

The MD Taber stiffness of the long needle nPCC sample (EXAMPLE 4) was 14% greater than the ethylated starch sample (EXAMPLE 1), 6% greater than the cubic nPCC sample (EXAMPLE 2), and 14% greater than the short needle nPCC sample (EXAMPLE 3).

The CD Taber stiffness of the long needle nPCC sample (EXAMPLE 4) was 17% greater than the ethylated starch sample (EXAMPLE 1), 10% greater than the cubic nPCC sample (EXAMPLE 2), and 27% greater than the short needle nPCC sample (EXAMPLE 3).

Example 5

Long Needle and Cubic nPCC Surface Layer

Seven 8½×11 sheets of 45 pound per ream newsprint were coated with ethylated starch (Penford Gum 280), long needle nPCC and cubic nPCC. The following is an average for the seven samples. The average total solids were 16% of the weight of the paper substrates, 8% Penford Gum 280, 4% long needle nPCC and 4% cubic nPCC. The average coated weight of the samples was 6.49 grams. The average coat weight was 4.6 grams or 116.3 pounds per ton. The ambient viscosity was 290/2. The samples were dried. The average dry weight of the samples was 4.76 grams. The samples were tested for machine direction (MD) and cross direction (CD) Gurley stiffness and machine direction and cross direction Taber stiffness. The average MD Gurley stiffness was 209.61, the average CD Gurley stiffness was 68.82, the average MD Taber stiffness was 2.56 and the average CD Taber stiffness was 0.94.

The MD Gurley stiffness of the long needle and cubic nPCC sample (EXAMPLE 5) was 22% greater than the ethylated starch sample (EXAMPLE 1), 11% greater than the cubic nPCC sample (EXAMPLE 2), and 13% greater than the short needle nPCC sample (EXAMPLE 3).

The CD Gurley stiffness of the long needle and cubic nPCC sample (EXAMPLE 5) was 22% greater than the ethylated starch sample (EXAMPLE 1), 12% greater than the cubic nPCC sample (EXAMPLE 2), and 28% greater than the short needle nPCC sample (EXAMPLE 3).

The MD Taber stiffness of the long needle and cubic nPCC sample (EXAMPLE 5) was 17% greater than the ethylated starch sample (EXAMPLE 1), 10% greater than the cubic nPCC sample (EXAMPLE 2), and 28% greater than the short needle nPCC sample (EXAMPLE 3).

The CD Taber stiffness of the long needle and cubic nPCC sample (EXAMPLE 5) was 24% greater than the ethylated starch sample (EXAMPLE 1), 16% greater than the cubic nPCC sample (EXAMPLE 2), and 34% greater than the short needle nPCC sample (EXAMPLE 3).

TABLE 1 below summarizes the data from EXAMPLES 1-5.

TABLE 1

| | Sample | | | | |
|---|---|---|---|---|---|
| | Example 1 Ethylated Starch | Example 2 Cubic nPCC | Example 3 Short Needle nPCC | Example 4 Long Needle Npcc | Example 5 Long and Cubic nPCC |
| Total solids | 8% EStarch | 16% Total 8% EStarch 8% CnPCC | 16% Total 8% EStarch 8% SNnPCC | 16% Total 8% EStarch 8% LNnPCC | 16% Total 8% EStarch 4% CnPCC 4% LNnPCC |
| Coated wt. of sample (g) | 6.41 | 6.46 | 6.35 | 6.54 | 6.49 |
| Coat Wt. (g) | 2.3 | 4.7 | 4.5 | 4.9 | 4.6 |
| Coating ambient viscosity | 62/2 | 355/2 | 344/2 | 356/2 | 290/2 |
| Dry wt. of sample (g) | 4.7 | 4.69 | 4.64 | 4.68 | 4.76 |
| Gurley Stiffness MD | 172.08 | 189.04 | 185.7 | 202.94 | 209.61 |
| Gurley Stiffness CD | 56.43 | 61.3 | 53.89 | 66.46 | 68.82 |
| Taber Stiffness MD | 2.18 | 2.33 | 2.17 | 2.48 | 2.56 |
| Taber Stiffness CD | 0.76 | 0.81 | 0.70 | 0.89 | 0.94 |

Example 6

Comparative Morphology

Four different paper samples were tested for stiffness and brightness. Sample A has a surface layer including control starch, without pigmentation. Sample B has a surface layer including cubic nPCC. Sample C has a surface layer including about 2 micron short needle nPCC. Sample D has a surface layer including about 4 micron long needle nPCC. The data in TABLE 2 below shows that Gurley and Taber stiffness values in both the MD and the CD increase significantly for samples having a surface layer including 4 micron long needle nPCC. In addition, brightness values increased for samples having a surface layer including cubic, 2 micron short needle nPCC, and 4 micron long needle nPCC.

TABLE 2

| | Sample | | | |
|---|---|---|---|---|
| | A Control Starch | B Cubic nPCC | C 2 micron Short Needle nPCC | D 4 micron Long Needle nPCC |
| Gurley Stiffness MD | 82.14 | 85.8 | 83.3 | 96.35 |
| Gurley Stiffness CD | 31.58 | 31.58 | 31.9 | 38.15 |
| Brightness | 76.14 | 76.7 | 76.9 | 77.18 |
| Taber Stiffness MD | 1.160 | 1.150 | 1.060 | 1.210 |
| Taber Stiffness CD | 0.388 | 0.440 | 0.466 | 0.440 |

Example 7

Lab Data

Paper characteristics were determined for four comparative samples having four different surface layers: Sample A includes a surface layer having control starch; Sample B includes a surface layer having nPCC and starch in a ratio of 0.43 to 1; Sample C includes a surface layer having nPCC and starch in a ratio of 0.80 to 1; and Sample D includes a surface layer having nPCC and starch in a ratio of 1.20 to 1; and Sample E includes a surface layer having GCC and starch in a ratio of 1.20 to 1. All nPCC samples used cubic nPCC.

The data in TABLE 3 below shows improved stiffness, porosity, and ink density characteristics with increased nPCC to starch ratios in the surface layer. Moreover, comparing the results for the GCC sample (Sample E) with the nPCC samples (Samples B. C, and D), GCC does not achieve the stiffness, porosity, and ink density characteristics achieved by the lowest ratio nPCC sample (SAMPLE B), and even does not perform as well as starch alone. (Sample A).

TABLE 3

| | Sample | | | | |
|---|---|---|---|---|---|
| | A Control Starch | B nPCC:Starch 0.43:1 | C nPCC:Starch 0.80:1 | D nPCC:Starch 1.20:1 | E GCC:Starch 1.20:1 |
| Gurley Stiffness MD | 39.68 | 41.12 | 49.84 | 45.12 | 39.7 |
| Gurley Stiffness CD | 10.68 | 11.68 | 11.67 | 12.98 | 11.14 |
| Taber Stiffness MD | 0.506 | 0.502 | 0.564 | 0.701 | 0.501 |
| Taber Stiffness CD | 0.212 | 0.200 | 0.211 | 0.232 | 0.211 |
| Hagerty Roughness | 70.5 | 71.7 | 67.6 | 68.8 | 70.9 |
| Gurley Porosity (sec/100 mL) | 88.2 | 110.5 | 122.9 | 137.4 | 99.7 |
| Opacity % | 92.833 | 93.283 | 92.887 | 94.741 | 92.9 |
| total color hexagon | 0.699 | 0.778 | | | 0.696 |
| Black ink density | 1.00 | 0.99 | | | 0.89 |
| Cyan ink density | 1.02 | 1.09 | | | 0.97 |
| Magenta ink density | 0.96 | 0.98 | | | 0.93 |
| Yellow ink density | 0.72 | 0.71 | | | 0.65 |
| Backside Black ink density | 0.09 | 0.08 | | | |
| Backside Cyan ink density | 0.03 | 0.02 | | | |
| Backside Magenta ink density | 0.03 | 0.02 | | | |
| Backside Yellow ink density | 0.03 | 0.01 | | | |

Example 8

Commercial Data

Paper characteristics are shown for five comparative samples having five different surface layers: Sample 1 includes a control starch surface layer; Samples 2-5 include nPCC surface layers, with similar starch contents and increasing amounts of nPCC in the surface layer. Sample 1 relating to starch control was included for comparison. All samples used cubic nPCC. The data was normalized for a constant base ash of 15% to provide accurate backside color bleed values.

The data in TABLE 4 below shows improved stiffness, porosity, and color parameters with increasing nPCC content in the surface layer.

TABLE 4

| | Sample | | | | |
|---|---|---|---|---|---|
| | 1 Starch | 2 nPCC | 3 nPCC | 4 nPCC | 5 nPCC |
| Basis Weight# | 45 | 45 | 45 | 45 | 45 |
| Starch (gsm) | 0.991 | 1.285 | 0.872 | 0.973 | 0.877 |
| nPCC (gsm) | 0 | 1.324 | 2.437 | 3.280 | 5.373 |
| total surface layer (gsm) | 1.307 | 2.609 | 3.309 | 4.253 | 6.250 |
| base ash % | 14.90 | 15.00 | 15.00 | 15.00 | 15.00 |
| surface layer ash % | 0.43 | 1.81 | 3.33 | 4.48 | 7.34 |
| total ash % | 15.33 | 16.81 | 18.33 | 19.48 | 22.34 |

TABLE 4-continued

| | Sample | | | | |
|---|---|---|---|---|---|
| | 1 Starch | 2 nPCC | 3 nPCC | 4 nPCC | 5 nPCC |
| Taber Stiffness MD | 2.203 | 2.663 | 2.368 | 2.654 | 2.451 |
| Taber Stiffness CD | 0.688 | 0.769 | 0.755 | 0.752 | 0.743 |
| Gurley porosity | 29 | 35 | 62 | 40 | 57 |
| Sheffield porosity | 108 | 92 | 58 | 80 | 61 |
| Total color hexagon | 0.65 | 0.66 | 0.78 | 0.71 | 0.79 |
| Black ink density | 1.00 | 0.98 | 0.98 | 0.99 | 0.99 |
| Cyan ink density | 0.95 | 0.95 | 1.08 | 0.99 | 1.07 |
| Magenta ink density | 0.95 | 0.94 | 1.03 | 0.98 | 1.03 |
| Yellow ink density | 0.72 | 0.72 | 0.75 | 0.74 | 0.75 |
| Backside color bleed-total color hexagon | 0.08 | 0.065 | 0.065 | 0.055 | 0.05 |

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A high-yield paper sheet, comprising:

at least about 50 weight percent mechanical pulp, wherein the basis weight of the sheet is in the range of about 24 to about 60 pounds/3000 $ft^2$, wherein the freeness of the sheet is from 110 to 150 Canadian Standard Freeness and wherein the porosity of the sheet is in the range of about 40 to about 100 Sheffield porosity.

2. The high-yield paper sheet of claim 1, further comprising at least about 10 weight percent kraft pulp.

3. The high-yield paper sheet of claim 1, further comprising kraft pulp in a range of about 10 to about 50 weight percent.

4. The high-yield paper sheet of claim 1, wherein the Taber CD stiffness of the sheet is in the range of about 0.7 to about 0.9.

5. The high-yield paper sheet of claim 1, wherein the caliper of the sheet is in the range of about 3.5 to about 6.5 mils.

6. The high-yield paper sheet of claim 1, wherein the brightness of the sheet is in a range of about 70 to about 100 TAPPI.

7. The high-yield paper sheet of claim 1, wherein the total color hexagon of the sheet is greater than about 0.70.

8. The high-yield paper sheet of claim 1, wherein the backside total color bleed of the sheet is in the range of about 0.01 to about 0.07.

9. The high-yield paper sheet of claim 1, wherein the high-yield paper includes a surface layer on the sheet.

10. The high-yield paper sheet of claim 9, wherein the surface layer includes pigment.

11. The high-yield paper sheet of claim 9, wherein the surface layer includes binder.

12. The high-yield paper sheet of claim 11, wherein the binder is selected from the group consisting of a binder component selected from the group consisting starch, latex, polyvinyl alcohol, carboxymethyl cellulose, glucomannan, protein, and other known binders, and any combination thereof.

13. A high-yield paper sheet, comprising:

at least about 50 weight percent mechanical pulp, wherein the basis weight of the sheet is in the range of about 35 to about 55 pounds/3000 $ft^2$, wherein the freeness of the sheet is from 110 to 150 Canadian Standard Freeness and wherein the porosity of the sheet is in the range of about 40 to about 100 Sheffield porosity.

14. The high-yield paper sheet of claim 13, further comprising kraft pulp in a range of about 10 to about 50 weight percent.

15. The high-yield paper sheet of claim 13, wherein the total color hexagon of the sheet is greater than about 0.70.

16. A high-yield paper sheet, comprising:

at least about 50 weight percent mechanical pulp, wherein the basis weight of the sheet is less than about 45 pounds/3000 $ft^2$, wherein the freeness of the sheet is from 110 to 150 Canadian Standard Freeness, wherein the porosity of the sheet is in the range of about 40 to about 100 Sheffield porosity, and wherein the total color hexagon of the sheet is greater than about 0.70.

17. The high-yield paper sheet of claim 16, further comprising kraft pulp in a range of about 10 to about 50 weight percent.

* * * * *

UNITED STATES PATENT AND TRADEMARK OFFICE

CERTIFICATE OF CORRECTION

PATENT NO. : 7,976,678 B2
APPLICATION NO. : 12/346681
DATED : July 12, 2011
INVENTOR(S) : Michael J. Dougherty et al.

It is certified that error appears in the above-identified patent and that said Letters Patent is hereby corrected as shown below:

Correct spelling of inventor's name is Brian S. Dalgardno.

Signed and Sealed this
Twenty-fifth Day of October, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,976,678 B2
APPLICATION NO. : 12/346681
DATED : July 12, 2011
INVENTOR(S) : Michael J. Dougherty et al.

It is certified that error appears in the above-identified patent and that said Letters Patent is hereby corrected as shown below:

Title Page, Item (75) Inventors, fourth inventor, "Brian S. Delgardno" should read --Brian S. Dalgardno.--

This certificate supersedes the Certificate of Correction issued October 25, 2011.

Signed and Sealed this
Twenty-second Day of November, 2011

David J. Kappos

David J. Kappos
*Director of the United States Patent and Trademark Office*